US007408142B2

(12) United States Patent
Beaulieu et al.

(10) Patent No.: US 7,408,142 B2
(45) Date of Patent: Aug. 5, 2008

(54) MICROCHANNEL AMPLIFIER WITH TAILORED PORE RESISTANCE

(75) Inventors: David R. Beaulieu, Groton, MA (US); Harry F. Lockwood, Waban, MA (US); Anton S. Tremsin, Lafayette, CA (US)

(73) Assignee: Arradiance, Inc., Sudbury, MA (US)

( * ) Notice: Subject to any disclaimer, the term of this patent is extended or adjusted under 35 U.S.C. 154(b) by 211 days.

(21) Appl. No.: 11/532,008

(22) Filed: Sep. 14, 2006

(65) Prior Publication Data

US 2007/0131849 A1 Jun. 14, 2007

Related U.S. Application Data

(60) Provisional application No. 60/596,324, filed on Sep. 16, 2005.

(51) Int. Cl.
*H01J 40/14* (2006.01)

(52) U.S. Cl. ..... 250/214 VT; 250/207; 313/103 CM

(58) Field of Classification Search ..... 250/214 VT, 250/207; 313/532, 103 R, 103 CM, 105 CM
See application file for complete search history.

(56) References Cited

U.S. PATENT DOCUMENTS

| | | | | |
|---|---|---|---|---|
| 3,863,094 | A | 1/1975 | Orthuber | |
| 5,064,396 | A | 11/1991 | Spindt | |
| 5,086,248 | A | 2/1992 | Horton et al. | |
| 5,205,902 | A | 4/1993 | Horton et al. | |
| 5,378,960 | A | 1/1995 | Tasker et al. | |
| 5,618,217 | A | 4/1997 | Then et al. | |
| 5,726,076 | A | 3/1998 | Tasker et al. | |
| 5,729,244 | A | 3/1998 | Lockwood | |
| 6,215,232 | B1 * | 4/2001 | Johnson et al. | 313/103 CM |
| 6,278,104 | B1 * | 8/2001 | Saldana et al. | 250/214 VT |
| 6,522,061 | B1 | 2/2003 | Lockwood | |

FOREIGN PATENT DOCUMENTS

EP 0 383 463 A2 8/1990

(Continued)

OTHER PUBLICATIONS

Shutte, N.M., et al., Application Of Microchannel Plates At High Count Rates, Instruments and Experimental Techniques, 1995, pp. 490-495, vol. 38, No. 4, Plenum Publishing Corporation.

(Continued)

*Primary Examiner*—Kevin Pyo
(74) *Attorney, Agent, or Firm*—Kurt Rauschenbach; Rauschenbach Patent Law Group, LLC

(57) ABSTRACT

A microchannel amplifier includes an insulating substrate that defines at least one microchannel pore through the substrate from an input surface to an output surface. A conductive layer is formed on an outer surface of the at least one microchannel pore that has a non-uniform resistance as a function of distance through the at least one microchannel pore. The non-uniform resistance is selected to simulate saturation by reducing gain as a function of input current and bias voltage compared with uniform resistance. A first and second electrode is deposited on a respective one of the input and the output surfaces of the insulating substrate. The microchannel amplifier amplifying emissions propagating through the at least one microchannel pore when the first and second electrodes are biased.

35 Claims, 12 Drawing Sheets

FOREIGN PATENT DOCUMENTS

| | | |
|---|---|---|
| EP | 0 413 482 B1 | 3/1997 |
| GB | 2 293 042 A | 3/1996 |
| GB | 2 409 927 A | 7/2005 |

OTHER PUBLICATIONS

Giudicotti, L., et al., Simple Analytical Model Of Gain Saturation In Microchannel Plate Devices, Rev. Sci. Instrum., Jan. 1994, p. 247, vol. 65, No. 1, American Institute Of Physics.

Ladislas Wiza, Joseph, Microchannel Plate Detectors, Nuclear Instruments and Methods, 1979, pp. 587-601, vol. 162.

Shikhaliev, P.M., Saturation Model For Secondary Electron Multiplier Detectors, Nuclear Instruments & Methods In Physics Research, 1999, pp. 202-212, Elsevier Science B.V.

Tremsin, Anton S., Advances In Microchannel Amplifiers For Maskless Lithography, MicroElectronic Engineering, 2006, Elsevier B.V.

Yi, Whikun, et al., Novel Fabrication Method Of Microchannel Plates, Review Of Scientific Instruments, Nov. 2000, pp. 4165-4169, vol. 71, No. 11, American Institiute of Physics.

* cited by examiner

MICROCHANNEL AMPLIFIER WITH TAILORED PORE RESISTANCE

RELATED APPLICATION SECTION

This application claims priority to U.S. Provisional Patent application Ser. No. 60/596,324, filed Sep. 16, 2005, and entitled "Method for Improving Saturation and Power Dissipation in a Secondary Electron Multiplier Channel Device by Tailoring Along the Pore Resistance." The entire application of U.S. Provisional Patent application Ser. No. 60/596,324 is incorporated herein by reference.

FEDERAL RESEARCH STATEMENT

This invention was made with Government support under Grant Number HR0011-05-9-0001, modification number P00003, awarded by the Defense Advanced Research Projects Agency (DARPA). The Government has certain rights in this invention.

BACKGROUND OF THE INVENTION

The present invention relates to microchannel plates (MCPs) and microchannel amplifiers (MCAs). A microchannel amplifier typically includes a large array of microchannel plate electron multipliers that are closely spaced. Each of the microchannel plate electron multipliers is a continuous dynode particle multiplier. Microchannel amplifiers can be formed into virtually any shape and size to provide the desired electron flux and amplification.

Microchannel plate electron multipliers operate on the principle of secondary electron emission. Electrons are spontaneously generated and amplified inside the microchannel plate electron multipliers when the electron multipliers are properly biased. An electron, charged particle, fast neutral particle, or photon entering the electron multipliers with sufficient energy causes a cascade of secondary electron emissions down the electron multiplier that ultimately exits the output of the electron multiplier.

Microchannel amplifiers are routinely used in many systems, such as mass spectrometry systems, to detect and amplify weak ion signals. Recently microchannel amplifiers have been used for electron beam sources, such as electron beam sources suitable for electron beam lithography applications.

BRIEF DESCRIPTION OF THE DRAWINGS

The aspects of this invention may be better understood by referring to the following description in conjunction with the accompanying drawings. Identical or similar elements in these figures may be designated by the same reference numerals. Detailed description about these similar elements may not be repeated. The drawings are not necessarily to scale. The skilled artisan will understand that the drawings, described below, are for illustration purposes only. The drawings are not intended to limit the scope of the present teachings in any way.

DETAILED DESCRIPTION

Reference in the specification to "one embodiment" or "an embodiment"means that a particular feature, structure, or characteristic described in connection with the embodiment is included in at least one embodiment of the invention. The appearances of the phrase "in one embodiment" in various places in the specification are not necessarily all referring to the same embodiment.

While the present teachings are described in conjunction with various embodiments and examples, it is not intended that the present teachings be limited to such embodiments. On the contrary, the present teachings encompass various alternatives, modifications and equivalents, as will be appreciated by those of skill in the art.

In particular, some aspects of the present invention are described in connection with a microchannel amplifier that is constructed from a silicon substrate with an insulating oxide layer and a polysilicon conductive layer. It should be understood that numerous types of insulating substrates and conductive layers that are known in the art can be used to fabricate the microchannel amplifier with tailored pore resistance according to the present invention. In addition, it is contemplated that the present invention can be practiced with future insulating substrates and conductive layers.

It should be understood that the individual steps of the methods of the present invention may be performed in any order and/or simultaneously as long as the invention remains operable. Furthermore, it should be understood that the apparatus and methods of the present invention can include any number or all of the described embodiments as long as the invention remains operable.

New electron beam sources are currently being developed for advanced electron beam lithography systems. These systems are direct write electron beam lithography systems that are massively parallel and that can have very high throughput. See, for example, U.S. Pat. No. 6,522,061 to Harry F. Lockwood, entitled "Field Emission Device with Microchannel Gain Element." U.S. Pat. No. 6,522,061 is assigned to the present assignee. These systems can have wafer throughputs that are greater than sixty wafers per hour.

Figure 1:
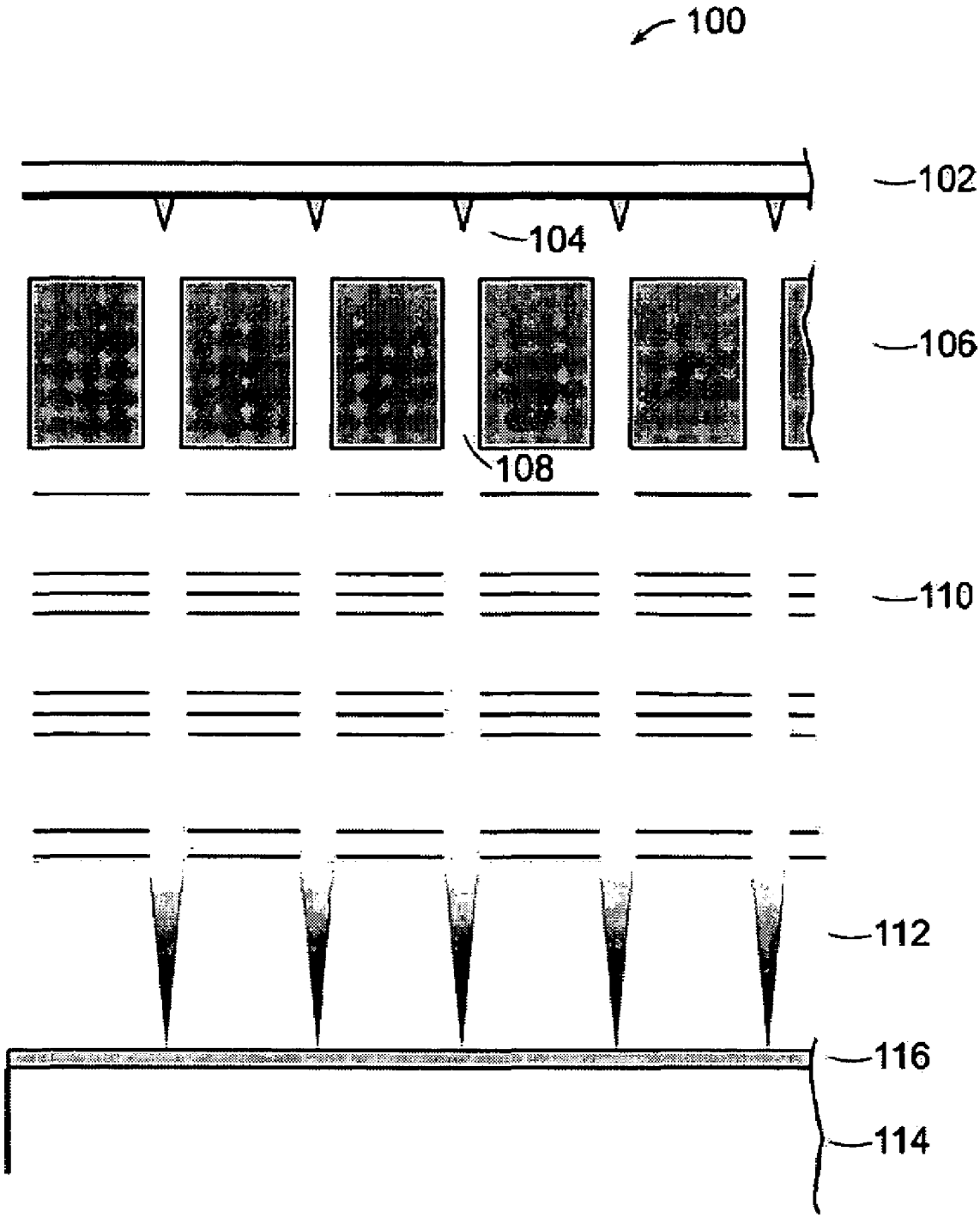
FIG. 1 PRIOR ART
FIG. 1 shows a known integrated electron beam source that includes a microchannel amplifier which is suitable for applications such as electron beam lithography.

FIG. 1 shows a known integrated electron beam source 100 that includes a microchannel amplifier which is suitable for applications such as electron beam lithography. The electron beam source 100 includes a field emitter array 102 that generates an array of micro-electron beams 104. In many embodiments, the field emitter array 102 is a low current field emitter array that generates thousands of micro-electron beams. Failure and instability rates generally depend exponentially on the drive current. Therefore, such field emitter arrays can have exceptionally long life and can be highly stable because they operate at very low current levels.

An array of microchannel amplifiers 106 is positioned adjacent to the field emitter array 102. The array of microchannel amplifiers 106 includes microchannel plates that define pores 108. The array of microchannel amplifiers 106 is formed from an insulating substrate. An insulating substrate is defined herein to mean a substrate that does not conduct any significant current. Common insulating substrates include glass, quartz (SiO2), sapphire, ceramic materials, some semi-insulating semiconductor materials, and semiconductors materials having insulating surface layers.

For example, in one embodiment, the array of microchannel amplifiers 106 is formed from a semiconductor substrate, such as the bulk silicon substrate with an insulating oxide layer, as described herein. In another embodiment, the array of microchannel amplifiers 106 is formed from a semi-insulating GaAs substrate (or other semi-insulating III-IV or II-VI semiconductor substrate).

The array of microchannel amplifiers 106 generates an array of amplified micro-electron beams from the array of micro-electron beams 104 generated by the field emitter array 102. The amplification of the array of micro-electron beams increases the current of the beams. In addition, the amplification of the array of micro-electron beams stabilizes the micro-electron beams in both current output and uniformity over the entire field. Generating a highly stable array of micro-electron beams is important for applications, such as electron beam lithography.

An electron beam lens array 110 is positioned adjacent to the array of microchannel amplifiers 106. In some embodiments, the electron beam lens array 110 is an array of micro-column electrostatic lenses. For example, the array of micro-column electrostatic lenses can be an array of 3-electrode Einzel lenses.

The electron beam lens array 110 focuses the array of micro-electron beams 112 generated by the array of microchannel amplifiers 106 onto a substrate 114 that contains an electron beam sensitive material 116 which forms an image when exposed to the required dose of electrons and then developed. A beam blanking system (not shown) is used to extinguish a portion of the array of micro-electron beams in areas where exposure is not desired.

It is desirable to operate the array of microchannel amplifiers 106 in the saturation region. The term "saturation" as applied to the microchannel amplifiers of the present invention is defined as a condition where the combination of device bias and input current produces an output current with reduced sensitivity to the input current. The term "saturation region" as applied to the microchannel amplifiers of the present invention is defined as a region where the output current of the array of microchannel amplifiers 106 remains relatively constant with input current changes.

That is, in the saturation region, the gain of the microchannel amplifier reduces with increasing input current, thus reducing the dynamic range of the microchannel amplifier. In other words, in the saturation region, most of the gain is achieved near the input of the pore and the gain near the output of the pore is approximately unity gain. Unity gain is when, on average, one electron striking the pore wall releases one secondary electron so that the average number of signal electrons in the pore does not substantially increase.

The resistance profile along the microchannel amplifier pores 108 determines the mode of signal amplification. A resistance profile that is characterized by a decreasing resistance along the pore from the input of the pore to the output of the pore results signal amplification that is substantially in the saturation region. In known microchannel amplifiers, the pore resistance is not well controlled. Saturation is achieved in these known microchannel amplifiers by increasing the pore potential, which causes a build up of wall charge that leads to a voltage profile along the pore that causes saturation. The theory of saturation is well known. See for, for example, "Saturation Model For Secondary Electron Multiplier Detectors", Nuclear Instr. And Meth. in Physics Res., A 420 (1999) 202-212.

Figure 2A:
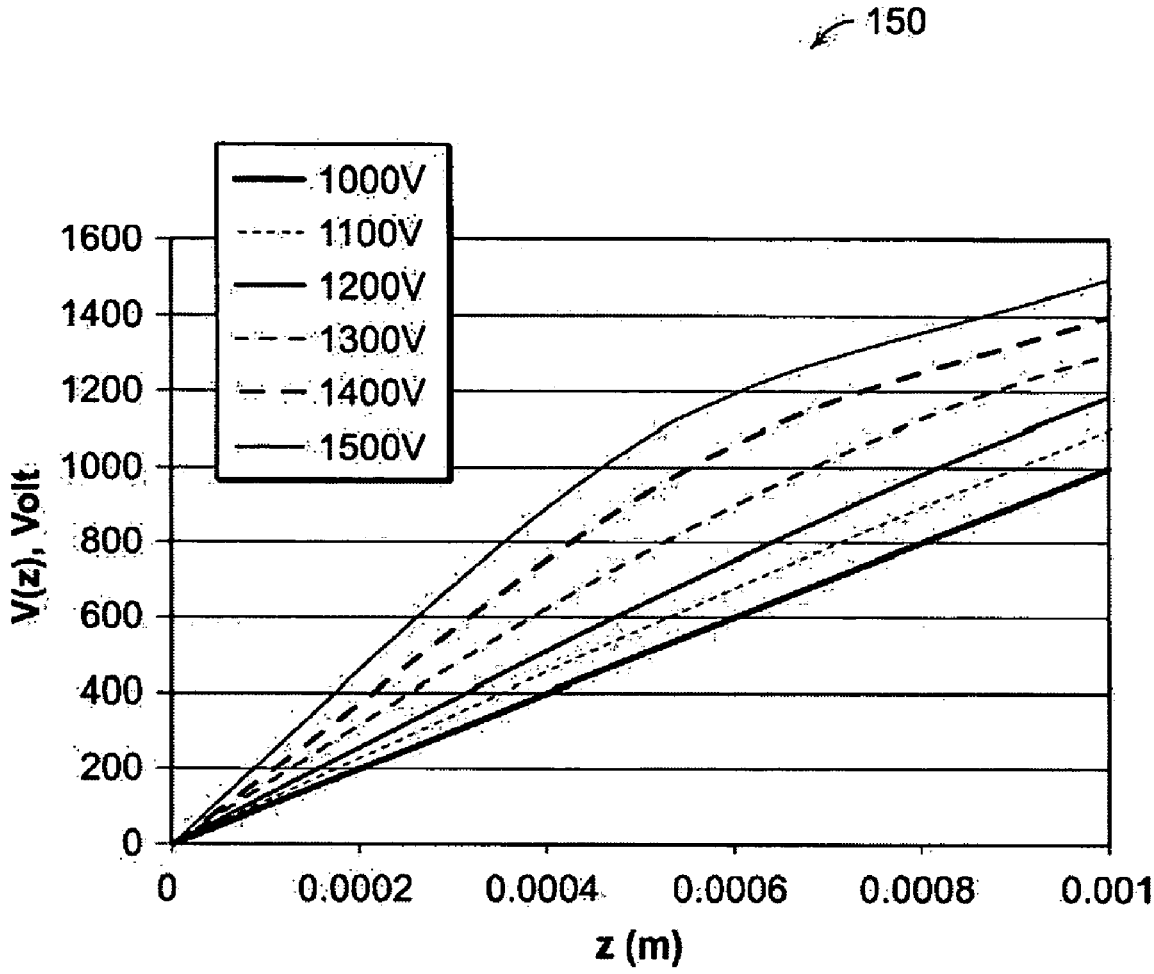
FIG. 2A is a plot of voltage as a function of distance through the microchannel amplifier pores for various bias voltages for a microchannel amplifier with a uniform resistance profile through the pores.

FIG. 2A is a plot 150 of voltage as a function of distance through the microchannel amplifier pores for various bias voltages for a microchannel amplifier with a uniform resistance profile through the pores. The ratio of the pore length to the pore diameter for this device is 80:1. The plot 150 indicates that there is a minimum voltage that is required for the microchannel amplifier to reach saturation. At a 1,000V bias voltage, the voltage changes linearly from the input of the pores to the output of the pores. At bias voltages that are higher than 1,000V, the voltage drop is relatively high proximate to the input of the pores and saturation is reached as some point along the pores before the output.

The plot 150 also indicates that the degree of saturation changes with increasing bias voltage across the pores. In addition, the plot 150 indicates that the input current and the dissipated power must be relatively high in order to achieve a relatively high saturated output current level. As the ratio of the pore length to the pore diameter increases, the required bias voltage and input current further increases.

Figure 2B:
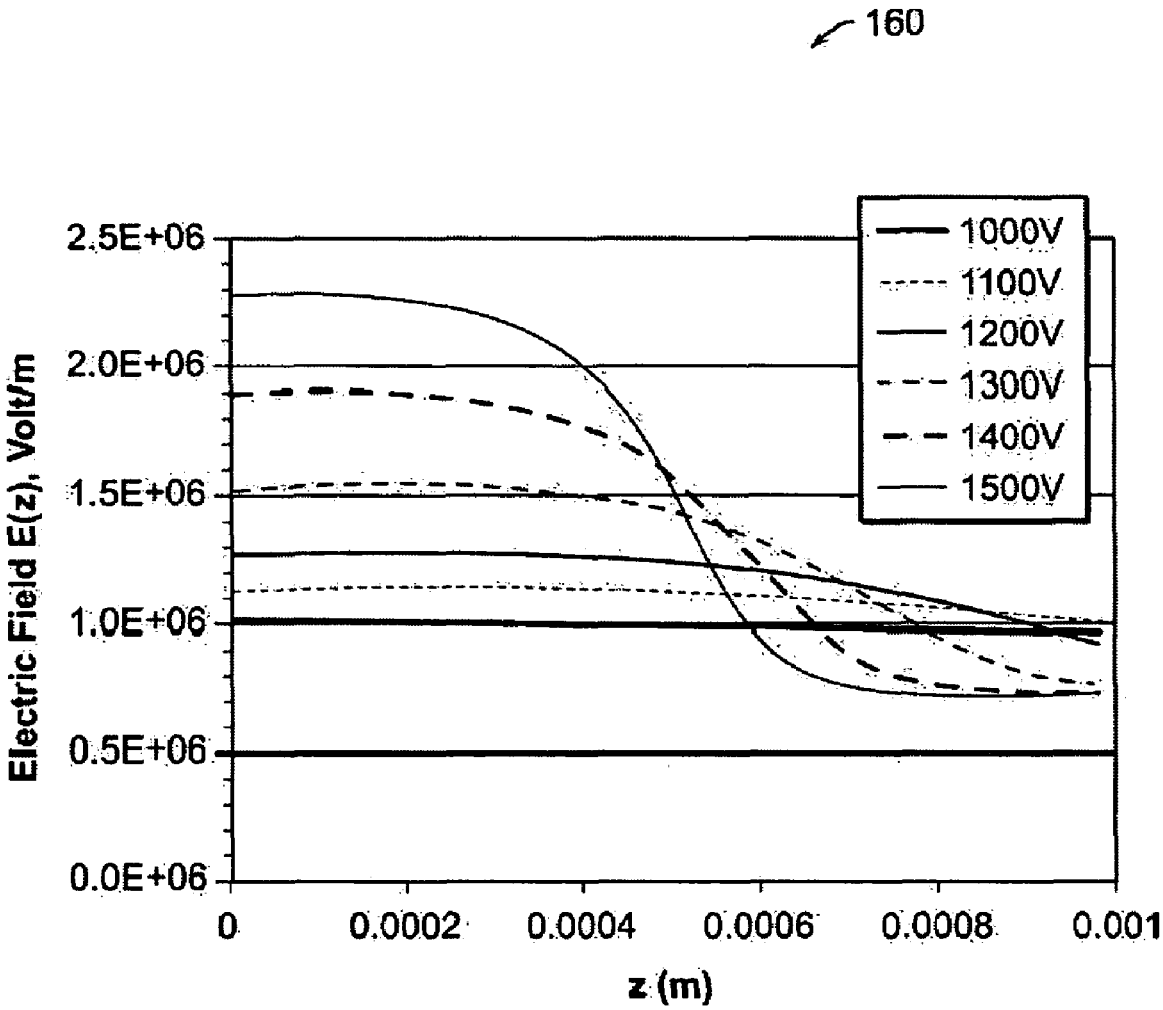
FIG. 2B is a plot of electric field as a function of distance through the microchannel amplifier pores for various bias voltages for a microchannel amplifier with a uniform resistance profile through the pores.

FIG. 2B is a plot 160 of electric field as a function of distance through the microchannel amplifier pores for various bias voltages for a microchannel amplifier with a uniform resistance profile through the pores. The ratio of the pore length to the pore diameter for this device is 80:1. The plot 160 indicates that there is a decreasing accelerating electric field proximate to the output of the pores as the bias voltage across the pores increases above 1,000V. Unity gain occurs when the electric field in the pore is not high enough to cause statistically significant electron multiplication.

Figure 2C:
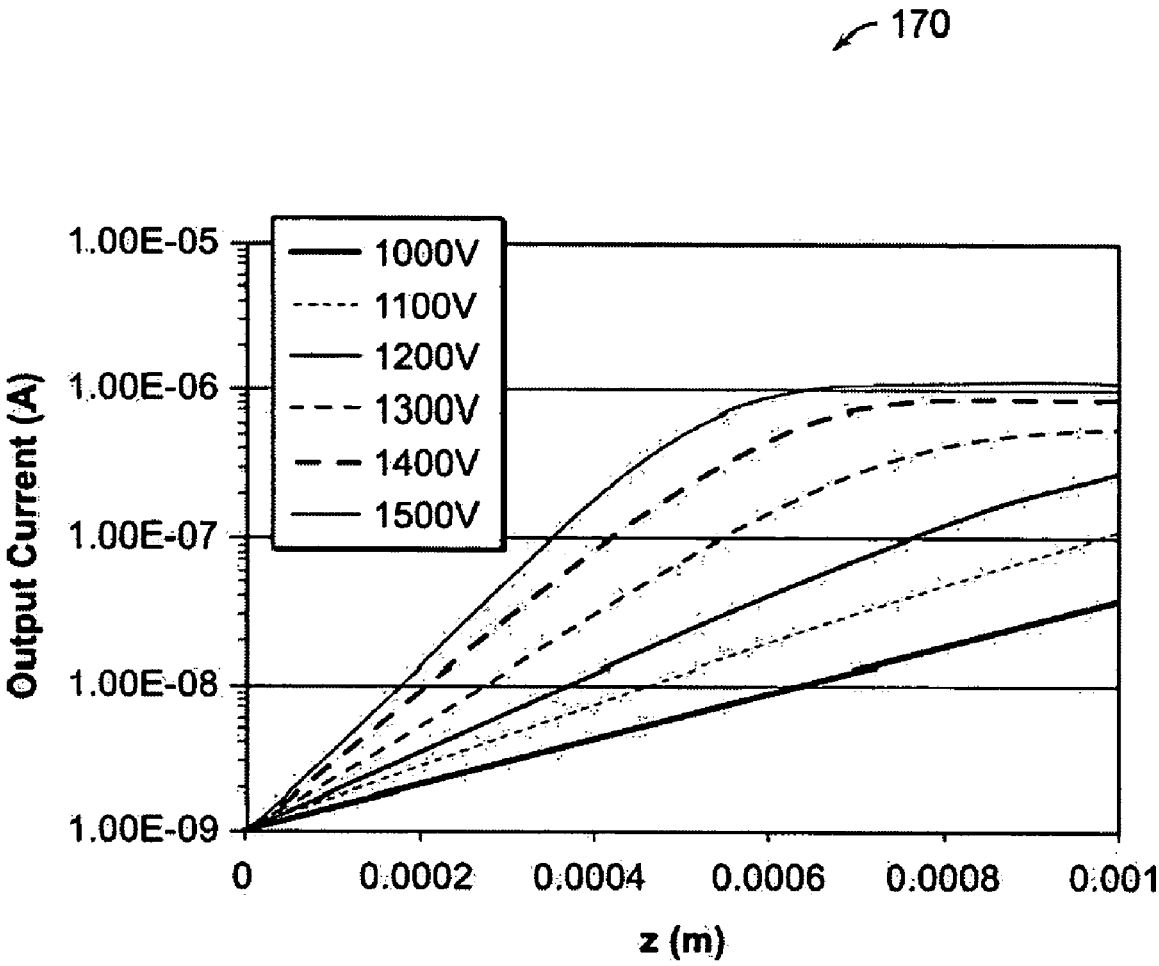
FIG. 2C is a plot of output signal current as a function of distance through the microchannel amplifier pores for various bias voltages for a microchannel amplifier with a uniform resistance profile through the pores.

FIG. 2C is a plot 170 of output signal current as a function of distance through the microchannel amplifier pores for various bias voltages for a microchannel amplifier with a uniform resistance profile through the pores. The ratio of the pore length to the pore diameter for this device is 80:1. The plot 170 indicates that the output signal current increases non-linearly for bias voltages across the pores that are above 1,000V.

One aspect of the present invention is that the resistance profile of microchannel amplifier pores can be tailored to provide precise control of saturation, which is independent of the pore voltage and the input current. The Applicants have discovered that by properly selecting the pore resistance profile through the pore, the gain of the pore and its operational voltage can be decoupled from the degree of saturation.

A microchannel amplifier according to the present invention has a tailored pore resistance. In one embodiment, the pore resistance is tailored to achieve precise control over saturation so that the device operates in the saturation mode with the desired characteristics. Using the methods of the present invention, the pore resistance profile can be tailored so that saturation occurs at a predetermined bias voltage and at a predetermined position along the pore. In this embodiment of the invention, the pore resistance profile is chosen so that the saturation condition achieves certain signal characteristics, such as output current stability, output current angular and energy distributions, and power dissipation in the pore.

In other embodiments, the pore resistance is tailored so that saturation is avoided. The mode of operation where saturation is avoided during normal operation is referred to herein as the "unsaturated mode." In the unsaturated mode of operation, the gain of the device continually increases over the desired operating range. These characteristics are useful for devices, such as microchannel amplifiers used in night vision equipment. Using the methods of the present invention, the pore resistance profile can be tailored so that the resistance proximate to the input of the pore is low relative to the resistance in the center and proximate to the output of the pore. The relatively low resistance proximate to the input of the pore causes the voltage as a function of distance through the microchannel amplifier pores to become highly unsaturated.

Figure 2D:
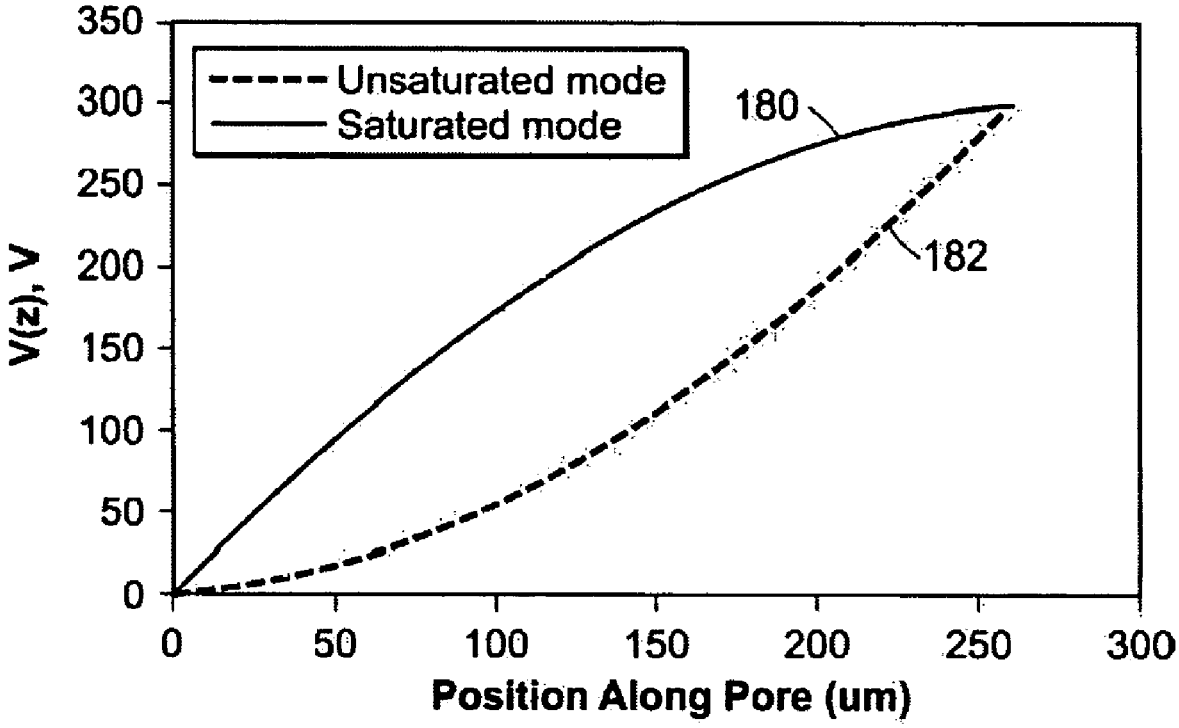
FIG. 2D illustrates a plot of voltage as a function of distance through the microchannel amplifier pores for microchannel amplifiers operating in both the saturation mode and the unsaturation mode.

FIG. 2D illustrates a plot 180 of voltage as a function of distance through the microchannel amplifier pores for microchannel amplifiers operating in both the saturation mode and the unsaturation mode. The plot 180 of the saturation mode indicates that saturation occurs before the output of the pores as described herein. This is the situation where the pore resistance is higher proximate to the input section of the pores. The plot 182 of the unsaturation mode indicates that saturation does not occur along pores. This is the situation where the pore resistance is higher proximate to the output of the pores.

Thus, a microchannel amplifier according to the present invention includes pores that are constructed to have a tailored resistance profile through the pore that improves certain operating characteristics of the microchannel amplifier. For example, in one embodiment, the tailored resistance profile is selected to artificially simulate a saturation condition, which lowers the required bias voltage and bias current necessary to achieve saturation.

Also, in one embodiment, the tailored resistance profile is selected to improve characteristics, such as stability and power dissipation. In another embodiment, the tailored resistance profile is selected to improve linearity in certain operating regions and/or to avoid saturation during normal operating conditions. In some particular embodiments, the resistance of the microchannel pore varies approximately linearly along at least a portion the length of the pore.

More specifically, a microchannel amplifier according to the present invention includes an insulating substrate that defines at least one microchannel pore through the substrate from an input surface to an output surface. In various embodiments, the insulating substrate can be formed of a semiconductor material, such as silicon with an insulating oxide layer or semi-insulating GaAs (or other III-V or II-IV semiconductor materials). A conductive layer having a non-uniform resistance as a function of distance through the pore is formed on an outer surface of the at least one microchannel pore. In various embodiments, the conductive layer is formed on the insulating substrate, in the insulating substrate, or is formed directly from the insulating substrate.

The non-uniform resistance is selected to improve certain operating characteristics such as to simulate saturation by reducing gain as a function of input current and bias voltage or to improve linearity compared with a uniform resistance. In some specific embodiments, the non-uniform resistance of the conductive layer is selected to minimize at least one of the bias voltage and the bias current necessary to achieve saturation, reduce power and/or heat dissipation, compared with a uniform doping profile.

To achieve these characteristics, the non-uniform resistance of the conductive layer can be selected to decrease or increase resistance as a function of distance through the microchannel pores from the input surface to the output surface. In some specific embodiments, the non-uniform resistance of the conductive layer is selected to decrease or increase resistance as a function of distance in an approximately linear manner. The non-uniform resistance of the conductive layer can also be selected to reduce or increase resistance in a predetermined area of the microchannel pores relative to other areas of the microchannel pores. In addition, the non-uniform resistance of the conductive layer can also be selected to achieve a predetermined resistance on at least one of the input and the output surface of the microchannel amplifier.

A first and second electrode is deposited on a respective one of the input and the output surfaces of the insulating substrate. In operation, the microchannel amplifier amplifies emissions propagating through the at least one microchannel pore when the first and second electrodes are properly biased.

Figure 3:
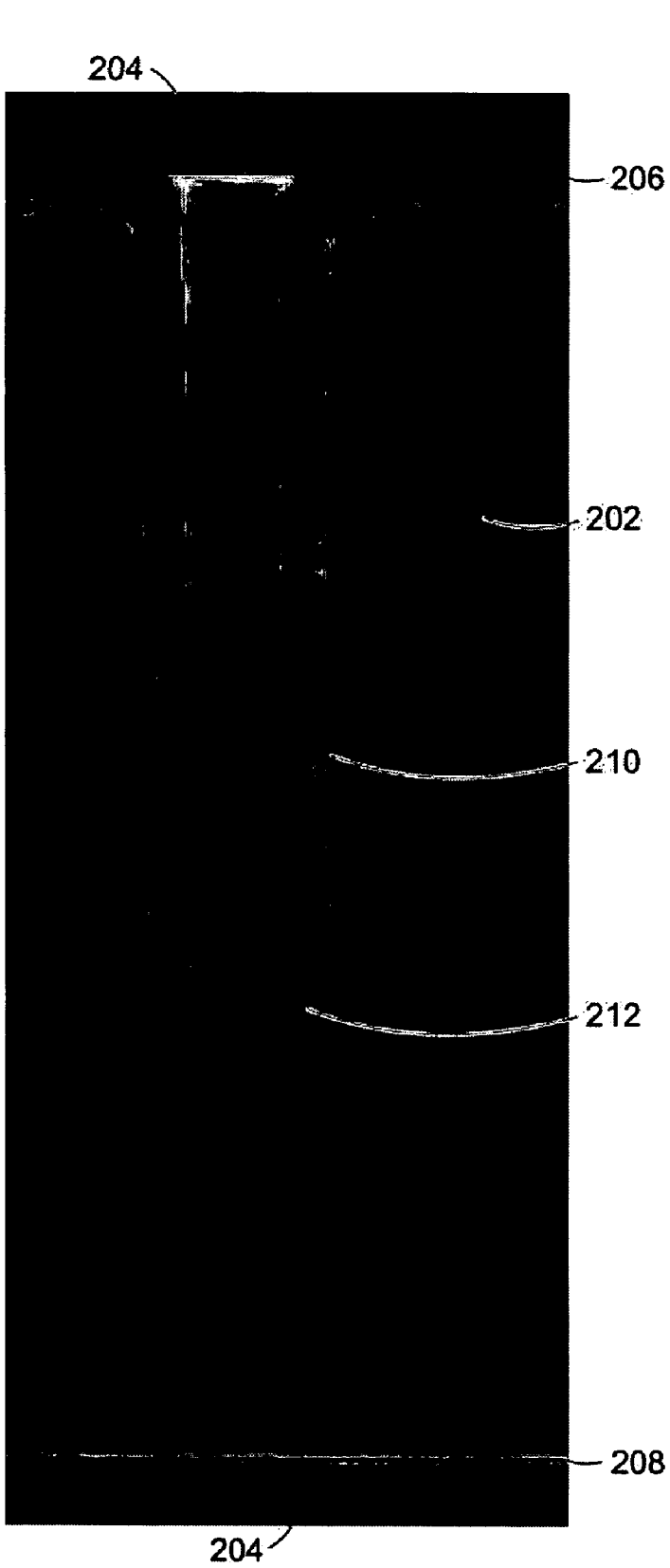
FIG. 3 illustrates one specific embodiment of a microchannel pore with a tailored pore resistance according to the present invention.

FIG. 3 illustrates a diagram of one specific embodiment of a microchannel pore 200 with a tailored pore resistance according to the present invention. In this embodiment, the microchannel amplifier is formed from a bulk silicon substrate 202. Silicon microchannel amplifiers have much higher gain compared with prior art glass microchannel amplifiers. For example, the gain of a silicon microchannel amplifier can be on order of twenty times higher than conventional microchannel amplifiers. Titanium gold electrodes 204 are formed on the input 206 and the output surfaces 208 of the pore 200.

A microchannel pore according the present invention exhibits improved characteristics, such as saturation and power dissipation, by tailoring the resistance profile through the pore. There are many known methods of fabricating and tailoring the resistance profile of high-aspect-ratio structures, such as the microchannel pore shown in FIG. 3. The present invention is not limited to any specific method of tailoring a resistance profile through a pore.

For example, in one embodiment, a microchannel pore according to the present invention is fabricated by first etching at least one pore into the bulk silicon substrate 202. A conformal dielectric layer 210 of silicon dioxide is then formed on the inside surface of the pores. In one specific embodiment, the thickness of the dielectric layer 210 is in the range of 1-5 microns thick. The dielectric layer 210 can be formed by one of numerous deposition methods known in the art. For example, the dielectric layer 210 can be a thermally grown oxide layer.

A conformal un-doped poly silicon layer 212 is formed on the dielectric layer 210. In one specific embodiment, the thickness of the un-doped poly silicon layer 212 is in the range of 0.1 to 5 microns. The un-doped poly silicon layer 212 is doped to form a conductive layer. For example, the un-doped poly silicon layer 212 can be doped by using a multi-step doping method that includes a combination of low pressure chemical vapor deposition (LPCVD) and high temperature atmospheric target doping (ballistic doping). In one specific embodiment, the layer of un-doped poly silicon is in the range of 0.1 to 5 microns thick. There are numerous variations of the microchannel pore 200 that are within the scope of the present invention.

Figure 4:
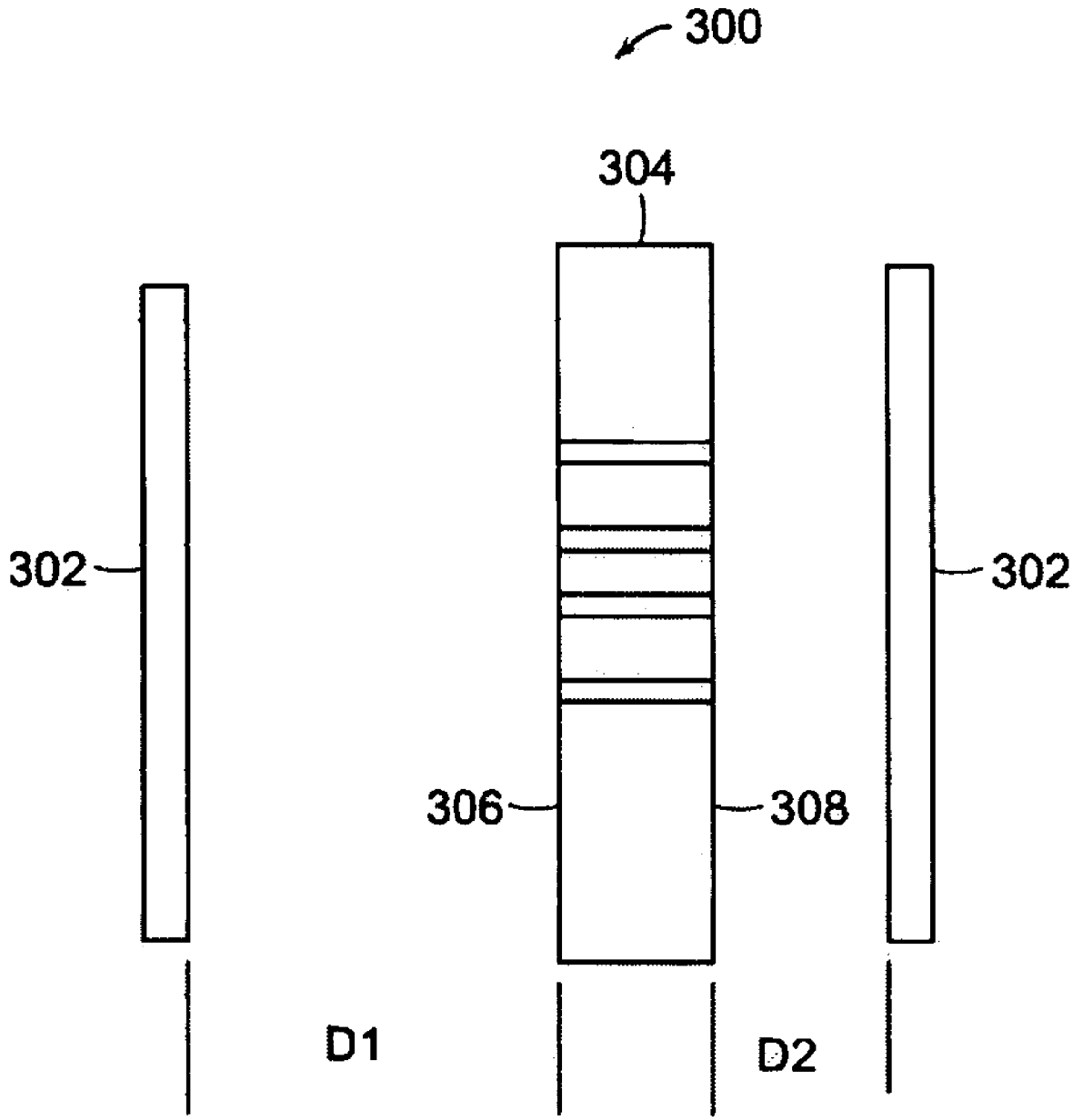
FIG. 4 illustrates a schematic diagram of a diffusion furnace for doping microchannel pores with a tailored doping profile according to the present invention.

FIG. 4 illustrates a schematic diagram of a diffusion furnace 300 for doping microchannel pores with a tailored doping profile according to the present invention. The diffusion furnace 300 includes boron targets 302 that are positioned to provide a source of boron dopant material. A wafer 304 having an un-doped poly silicon layer is positioned in the furnace 300 at a location that is offset from the center of the furnace 300. That is, a distance D1 from the first surface 306 of the wafer 304 to one side of the furnace 300 is typically not equal to a distance D2 from the second surface 308 of the wafer 304 to another side of the furnace 300. In one specific embodiment, the furnace 300 is operated at ambient pressure and the temperature inside the furnace is elevated to approximately 1,000 degrees Celsius.

The diffusion furnace 300 performs non-linear doping through the microchannel pore that changes the resistance of the microchannel pores as a function of distance along the pores. The net starting resistance on both surfaces of the wafer 304 and the doping profile through the pore can be tailored by properly selecting the distances D1 and D2 within the doping furnace 300. In addition, the net starting resistance on both surfaces of the wafer 304 and the doping profile through the pore can be tailored by properly selecting the flow rate of gas flowing within the diffusion furnace 300. There are numerous other doping methods known in the art for tailoring the resistance through a microchannel pore according to the present invention.

Figure 5:
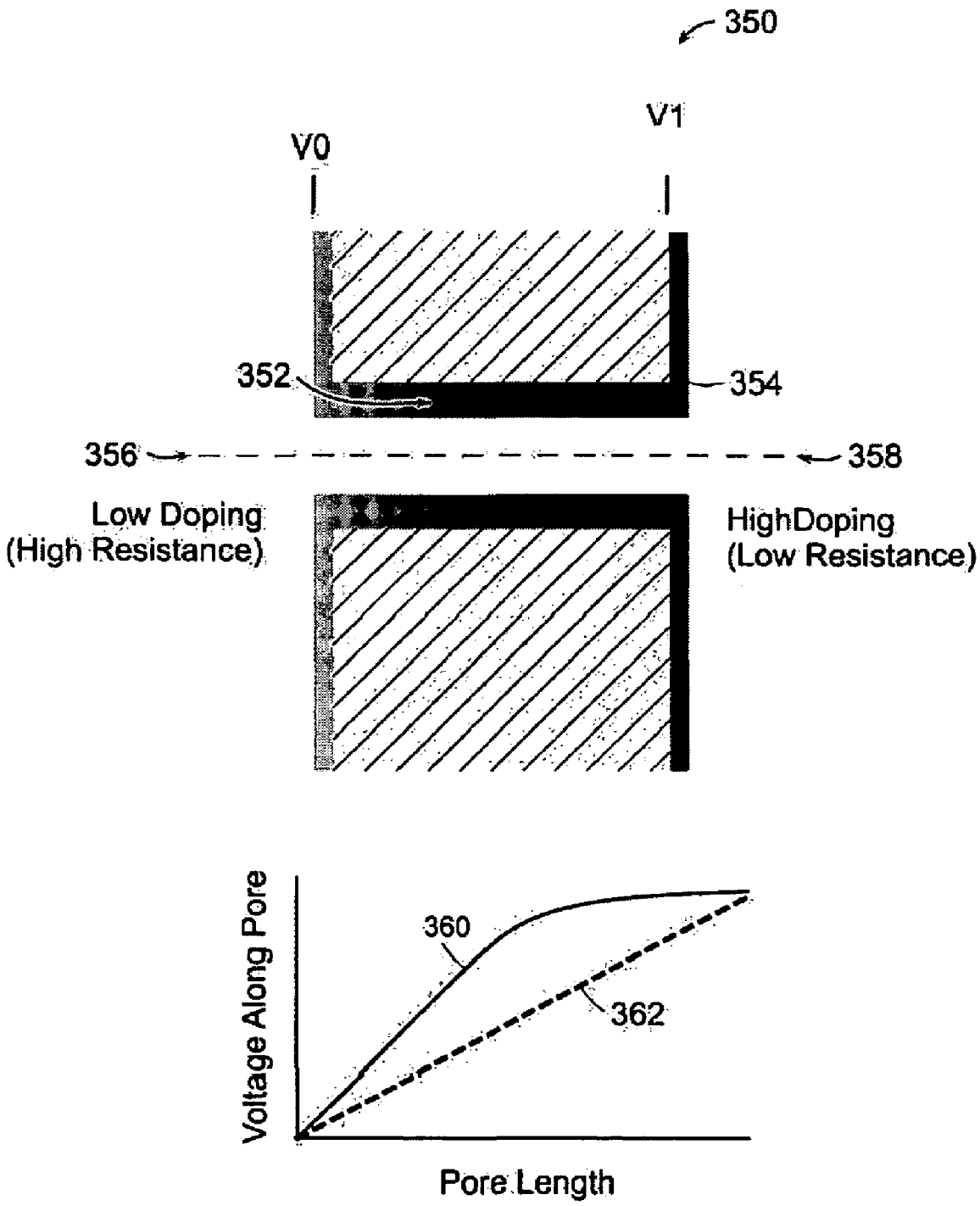
FIG. 5 shows a schematic diagram of a cross section of a microchannel pore illustrating a doping profile of a conductive layer through a pore according to the present invention and the resulting voltage along the pore as a function of distance through the pore.

FIG. 5 shows a schematic diagram of a cross section of a microchannel pore 350 illustrating a doping profile 352 of a conductive layer 354 through a pore according to the present invention and the resulting voltage along the pore as a function of distance through the pore. The doping profile 352 indicates that the doping level is lowest at the pore input 356, which causes a relatively high resistance proximate to the pore input 356. The doping profile 352 also indicates that the doping level is highest at the pore output 358, which causes a relatively low resistance proximate to the pore output 358. In many embodiments, the doping level monotonically increases through the pore from the pore input 356 to the pore output 358. In one specific embodiment, the doping level increases through the pore 350 so as to create an approximately linear decrease in the pore resistance from the pore input 356 to the pore output 358.

FIG. 5 also illustrates the resulting voltage profile 360 along the pore as a function of distance through the pore that is caused by the change of material resistance along the pore. For comparison a voltage profile 362 is shown for a pore with a uniform resistance conductive layer.

Figure 6:
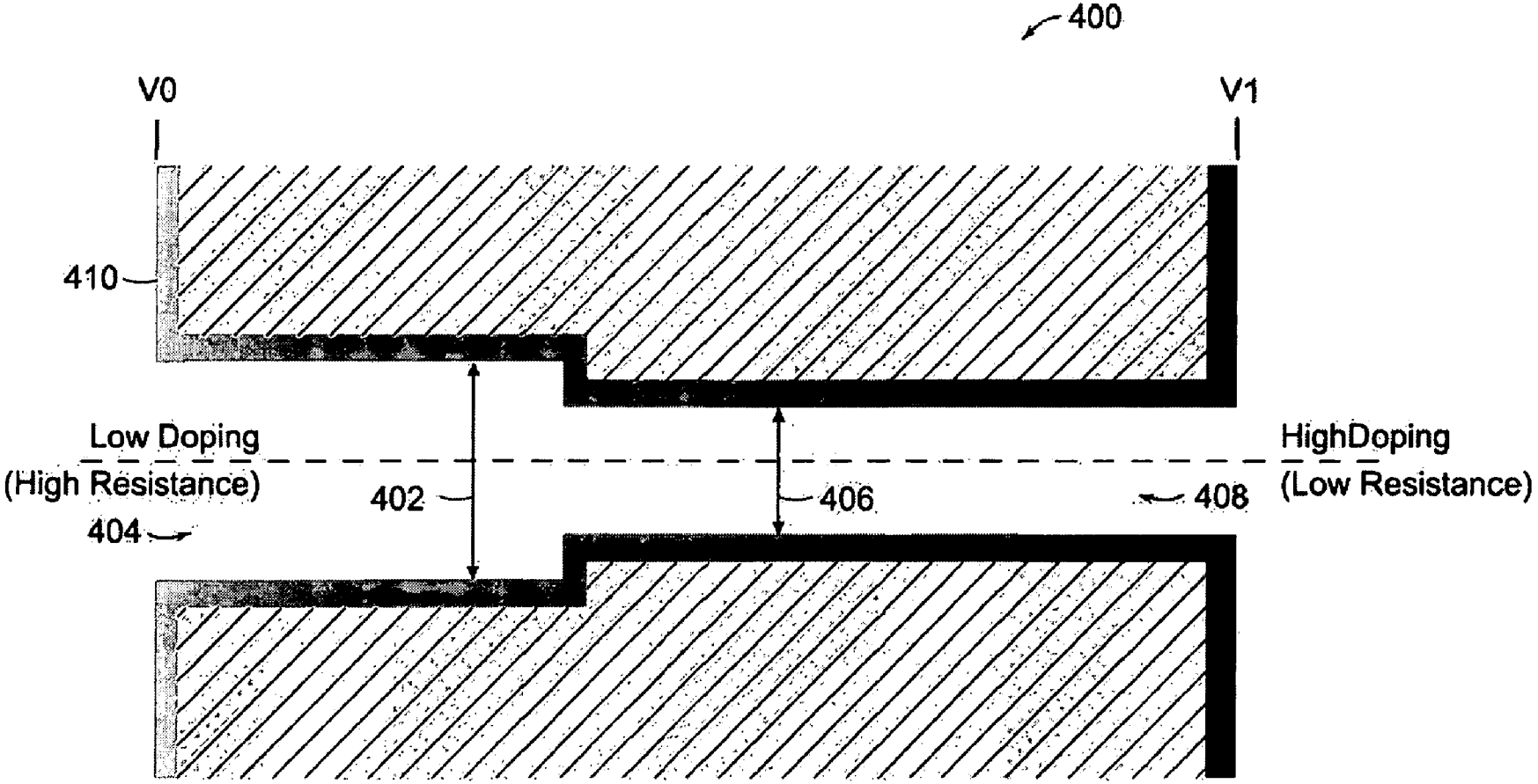
FIG. 6 illustrates a schematic diagram of a cross section of a pore according the present invention with a pore geometry having a first diameter proximate to the input and a second diameter proximate to the output.

FIG. 6 illustrates a schematic diagram of a cross section of a pore 400 according the present invention with a pore geometry having a first diameter 402 proximate to the input 404 and a second diameter 406 proximate to the output 408. The first diameter 402 is relatively narrow in order to enhance the acceptance angle for particles entering into the pore 400. The second diameter 404 is relatively wide in order to enhance the current density of the electron beam exiting the pore. In some embodiments, the second diameter 406 is chosen to match the dimensions and characteristics of certain lenses.

The doping level of the conductive layer 410 proximate to the input 404 is relatively low. Consequently, the pore resistance proximate to the input 404 is relatively high. The doping level of the conductive layer 410 proximate to the output 408 is relatively high. Consequently, the pore resistance proximate to the output 408 is relatively low. In some embodiments, the conductive layer 410 in the section of the pore 400 that is proximate to the input 404 is doped with one doping method and the conductive layer 410 in the section of the pore 400 that is proximate to the output 408 is doped with another doping method.

The pore 400 shown in FIG. 6 having the first diameter 402 and the second diameter 406 is advantageous because it exhibits a pore geometry with both a relatively wide input acceptance aperture and a relatively small output aperture. Such a geometry results in a relatively efficient design that generates a relatively high current density. In some embodiments, lenses can be attached or positioned proximate to the output 408 in order to further increase the current density of the output beam.

Fabricating a two section pore with both a relatively wide and a relatively narrow section allows the use of etching techniques that result in narrower and more uniformly dimensioned pores. In addition, fabricating a two section pore with both a relatively wide and a relatively narrow section allows the use of some doping methods that provide independent control of doping parameters in the each of the input and output sections.

Accurately measuring the pore resistance as a function of distance through the pore is difficult because the pores are essentially very narrow and deep trenches. In one embodiment, a scanning electron microscope (SEM) is used to measure pore resistance through the pores. The scanning electron microscope is configured to generate a very narrow electron beam that probes inside the pores at various positions. The microchannel amplifier including the plurality of pores is positioned on the specimen holder of the SEM. The specimen holder is typically adjustable in three dimension (X, Y, Z) and angle. The specimen holder is adjusted so that the microchannel amplifier presents the pore under test at the desired angle relative to the direction of the electron beam generated by the SEM so as to cause the electron beam to strike the desired inside portion of the pore.

The pore resistance as a function of distance along the pore can be determined from a measurement of secondary electron emission emanating from the pore as a function of the incident electron beam current and the relative angle between the surface of the micro-channel amplifier and the incident electron beam. As the focused beam is moved along the opening of the pore in along the tilt axis, the effective pore length (L)/pore diameter (D) ratio of the micro-channel amplifier pore changes. The pore resistance as a function of distance along the pore can be determined from changes in channel output as a function of varying L/D positions.

Known equations for the ratio of gain/output as function of the ratio of the pore length (L) to the pore diameter (D) are used to estimate deviations from the theoretical output for a constant material resistance. A first order approximation can be made for a micro channel amplifier operating in a linear regime where the output gain (g) relationship to the pore length (L)/pore diameter(D) ratio:

$$g = e^{G*\frac{L}{D}}$$

where (G) is the gain factor. The gain factor (G) incorporates the device transfer characteristics including such factors as the secondary emission yield efficiency, the device bias voltage and other operational characteristics. Change in resistance along the pore can be estimated in a linear regime from the of output gain and know relationships between the channel gain and the strip current. In the linear region, the channel gain is nearly linear with changes in strip current.

Figure 7B:
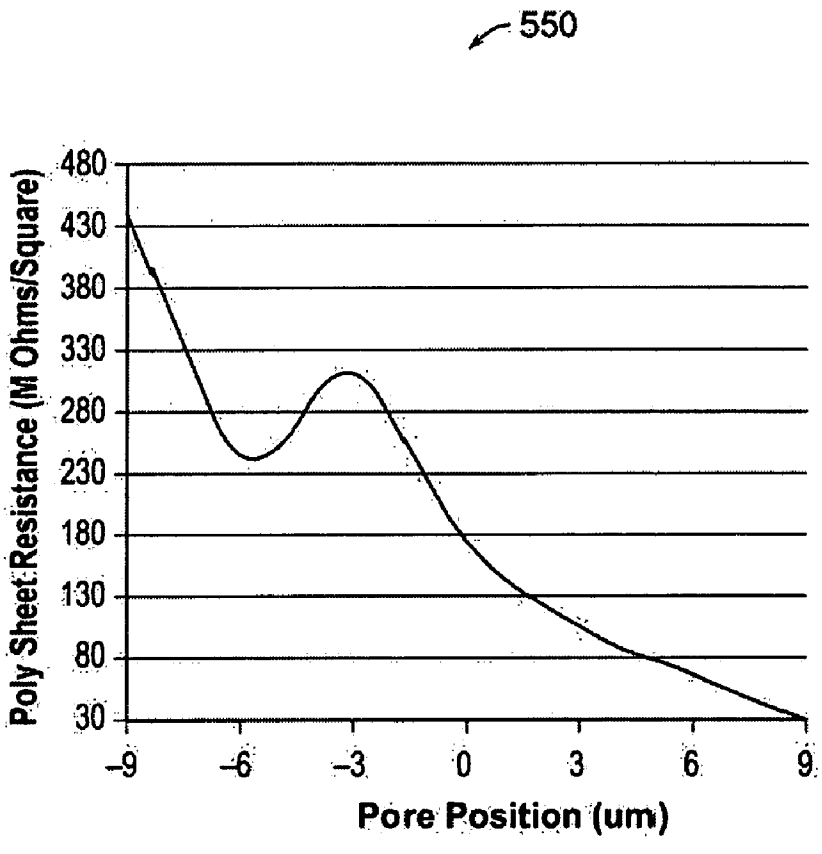
FIG. 7B illustrates a plot of sheet resistance in M Ohms/square as a function of position along the pore for a microchannel amplifier according to the present invention.
Figure 7A:
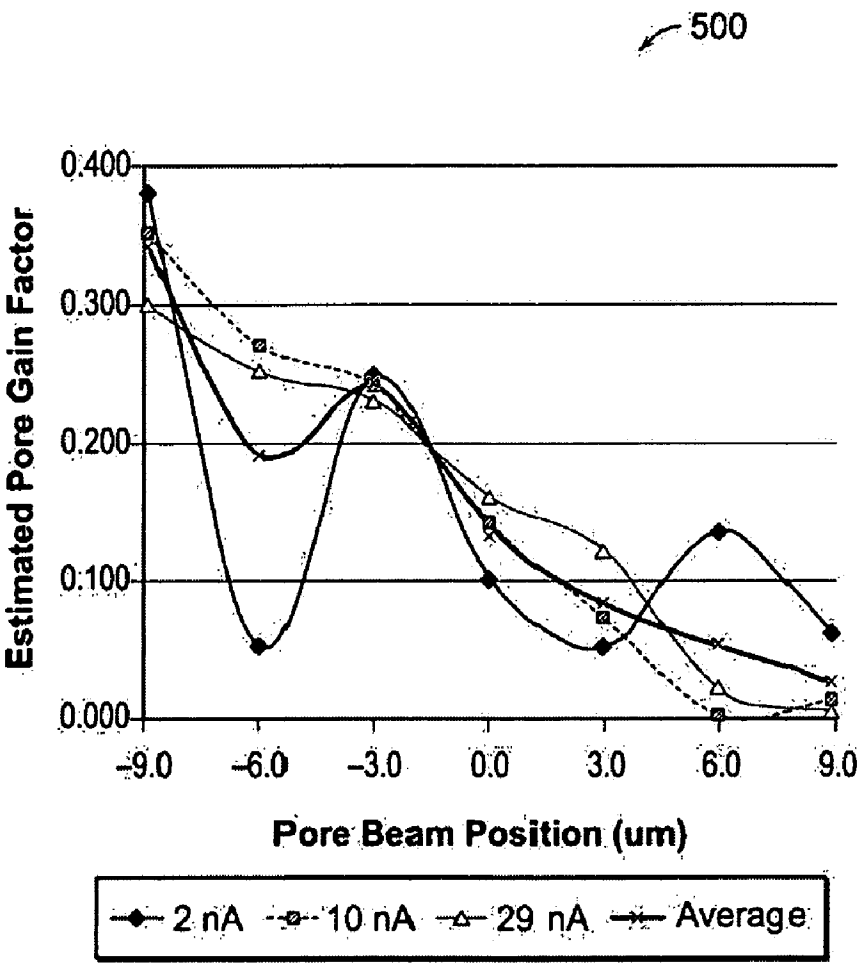
FIG. 7A illustrates a plot of estimate pore gain factor (G) from experimental gain measurements as a function of position along the pore of a focused incident electron beam for a microchannel amplifier according to the present invention.

FIG. 7A illustrates a plot 500 of estimate pore gain factor (G) from experimental gain measurements as a function of position along the pore of a focused incident electron beam for a micro channel amplifier according to the present invention. The position along the pore can be related geometrically to the pore length (L) to pore diameter (D) ratio. If the material resistance of the pore were constant, the gain factor is expected to be a constant.

These data were obtained for a microchannel amplifier that was tilted at four degrees relative to the incident electron beam. The bias voltage was 300 volts. The accelerating voltage was 500 volts. The plot indicates that the gain factor decreases as a function of distance from the pore input to the pore output.

FIG. 7B illustrates a plot 550 of sheet resistance in M Ohms/square as a function of position along the pore for a microchannel amplifier according to the present invention. The plot indicates that the sheet resistance decreases as a function of distance through the pore. The measurements of sheet resistance are based on an average of the 2, 10, and 29 nA incident electron beam currents and a measured 70K Ohm pore resistance. The measurements of pore gain factor (G) and sheet resistance as a function of position demonstrate the ability to change the material resistance along the pore. The ability to tune resistance along the pore can change the operational characteristics such that either early saturation or extended linear range can be achieved.

Figure 8B:
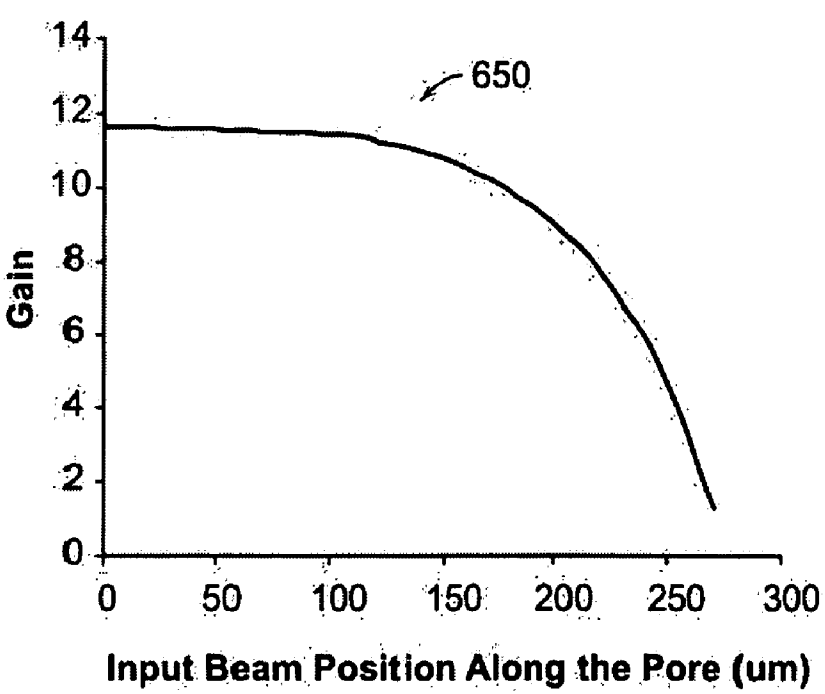
FIG. 8B illustrates a plot of calculated gain as a function of position along the pore for a microchannel amplifier according to the present invention.
Figure 8A:
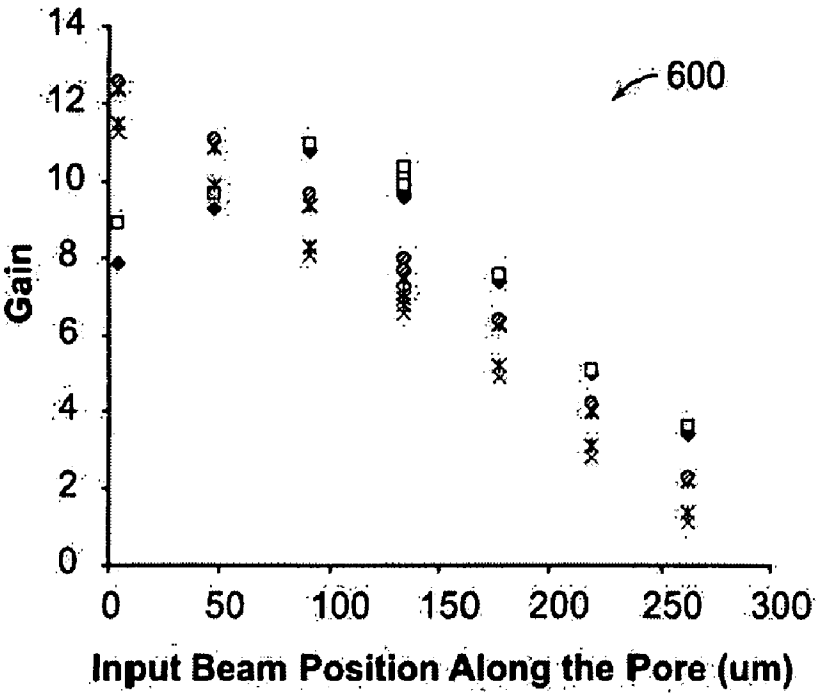
FIG. 8A illustrates a plot of experimentally measured gain as a function of position through the pore for a microchannel amplifier according to the present invention.

FIG. 8A illustrates a plot 600 of experimentally measured gain as a function of position through the pore for a microchannel amplifier according to the present invention. FIG. 8B illustrates a plot 650 of calculated gain as a function of position along the pore for a microchannel amplifier according to the present invention. The calculated gain data is modeled for a bulk resistance that varies linearly along the pore from $2\times10^4$ to $3\times10^5$.

Figure 9:
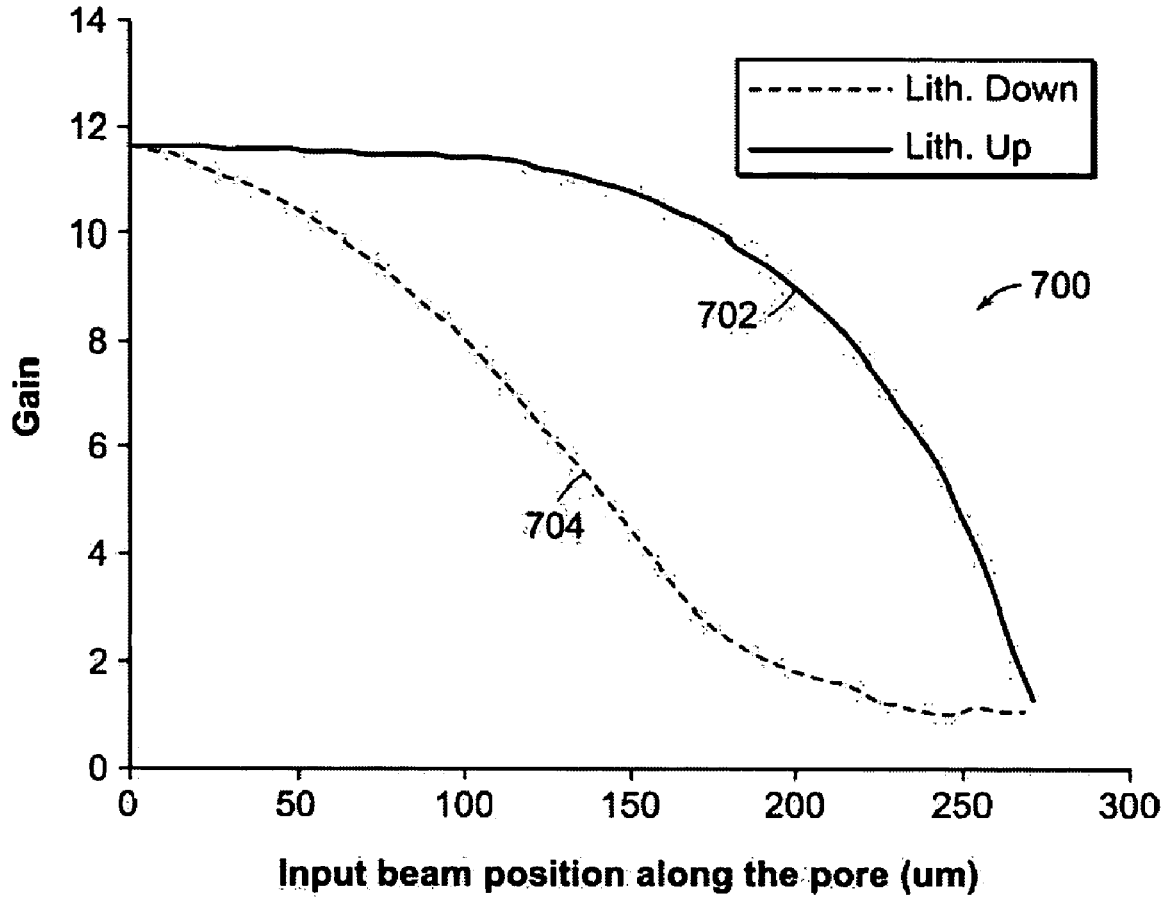
FIG. 9 illustrates a plot of calculated gain as a function of distance through the pore for the two pore orientations.

FIG. 9 illustrates a plot 700 of calculated gain as a function of distance through the pore for the two pore orientations. The calculated gain data is modeled for a bulk resistance that varies linearly along the pore from $2\times10^4$ to $3\times10^5$. The plot indicates that the calculated gain is strongly dependent upon the orientation of the pore. The measured output current had different levels of saturation for the two different microchannel amplifier pore orientations. The gain curve 702 where the lithography side is positioned up indicates significantly higher gain then the gain curve 704 where the lithography side is positioned down. Saturation models agree with measured results.

There are many applications of the present invention. For example, the methods and apparatus of the present invention will allow the tailoring of resistance profiles of pores to optimize output saturation levels, power consumption, heat dissipation, and emission. In addition, the methods and apparatus of the present invention will also allow reduction of resistance in specific area of the channel. A combination of insitu LPCVD doping and ballistic doping can be used to accurately control the doping profile in specific regions of the pores.

EQUIVALENTS

While the present teachings are described in conjunction with various embodiments and examples, it is not intended that the present teachings be limited to such embodiments. On the contrary, the present teachings encompass various alternatives, modifications and equivalents, as will be appreciated by those of skill in the art, may be made therein without departing from the spirit and scope of the invention.

What is claimed is:

1. A microchannel amplifier comprising:

a) an insulating substrate that defines at least one microchannel pore through the substrate from an input surface to an output surface;

b) a conductive layer that is formed on an outer surface of the at least one microchannel pore, the conductive layer having a non-uniform resistance as a function of distance through the at least one microchannel pore, the non-uniform resistance being selected to simulate saturation by reducing gain as a function of input current and bias voltage compared with uniform a resistance; and c) a first and a second electrode that are deposited on a respective one of the input and the output surfaces of the insulating substrate, the microchannel amplifier amplifying emissions propagating through the at least one microchannel pore when the first and second electrodes are biased.

2. The microchannel amplifier of claim 1 wherein the conductive layer is formed in the insulating substrate.

3. The microchannel amplifier of claim 1 wherein the conductive layer is formed from the insulating substrate.

4. The microchannel amplifier of claim 1 wherein the insulating substrate comprises a semiconductor material.

5. The microchannel amplifier of claim 1 wherein the insulating substrate comprises a silicon substrate.

6. The microchannel amplifier of claim 1 wherein the non-uniform resistance of the conductive layer is selected to minimize at least one of the bias voltage and the bias current necessary to achieve saturation.

7. The microchannel amplifier of claim 1 wherein the non-uniform resistance of the conductive layer is selected to reduce power dissipation compared with a uniform doping profile.

8. The microchannel amplifier of claim 1 wherein the non-uniform resistance of the conductive layer is selected to improve heat dissipation compared with a uniform doping profile.

9. The microchannel amplifier of claim 1 wherein the non-uniform resistance of the conductive layer is selected to decrease resistance as a function of distance through the at least one microchannel pore from the input surface to the output surface.

10. The microchannel amplifier of claim 1 wherein the non-uniform resistance of the conductive layer is selected to decrease resistance from the input surface to the output surface with an approximately linear function of distance through the plurality of microchannel pores.

11. The microchannel amplifier of claim 1 wherein the non-uniform resistance of the conductive layer is selected to reduce resistance in a predetermined area of the plurality of microchannel pores relative to other areas of the plurality of microchannel pores.

12. The microchannel amplifier of claim 1 wherein the non-uniform resistance of the conductive layer is selected to achieve a predetermined resistance on at least one of the input and the output surface of the microchannel amplifier.

13. The microchannel amplifier of claim 1 wherein at least some of the microchannel pores comprise a first diameter proximate to the input surface and a second diameter proximate to the output surface of the microchannel pores.

14. The microchannel amplifier of claim 13 wherein the diameter proximate to the input surface of the microchannel pores is greater than the diameter proximate to the output surface of the microchannel pores in order to increase an acceptance angle electrons.

15. A method of fabricating a microchannel amplifier, the method comprising:

a) forming at least one microchannel pore through an insulating substrate from an input surface to an output surface;

b) forming a conductive layer on an outer surface of the at least one microchannel pore, the conductive layer having a non-uniform resistance as a function of distance through the at least one microchannel pore that simulates saturation by reducing gain as a function of input current and bias voltage compared with uniform resistance; and c) depositing a first and a second electrode on a respective one of the input and the output surfaces of the insulating substrate.

16. The method of claim 15 wherein the forming the conductive layer comprises doping a surface of the insulating substrate.

17. The method of claim 15 wherein the forming the conductive layer comprises performing a multi-step doping method.

18. The method of claim 15 wherein the forming the conductive layer comprises diffusing a conductive layer in a diffusion furnace where the at least one microchannel pore is positioned at a location that causes the non-uniform doping.

19. The method of claim 18 wherein the location that causes the non-uniform doping is offset from a center of the diffusion furnace.

20. The method of claim 15 wherein the forming the conductive layer comprises diffusing a conductive layer in a diffusion furnace wherein a flow rate of gas in the diffusion furnace is chosen to produce the non-uniform doping profile.

21. The method of claim 15 wherein the forming the conductive layer comprises performing a combination of low pressure chemical vapor deposition and ballistic doping.

22. The method of claim 15 wherein the forming the conductive layer comprises performing atomic layer deposition.

23. The method of claim 15 wherein the forming the conductive layer comprises forming a conductive layer having a non-uniform resistance as a function of distance through the at least one microchannel pore that minimizes at least one of a bias voltage and a bias current necessary to achieve saturation.

24. The method of claim 15 wherein the forming the conductive layer comprises forming a conductive layer having a non-uniform resistance as a function of distance through he at least one microchannel pore that reduces power dissipation compared with a uniform doping profile.

25. The method of claim 15 wherein the forming the conductive layer comprises forming a conductive layer having a non-uniform resistance as a function of distance through he at least one microchannel pore that improves heat dissipation compared with a uniform doping profile.

26. The method of claim 15 wherein the forming the conductive layer comprises forming a conductive layer having a non-uniform resistance as a function of distance through the at least one microchannel pore that achieves a predetermined resistance on at least one of the input and the output surfaces.

27. A microchannel amplifier comprising:

a) an insulating substrate that defines at least one microchannel pore through the substrate from an input surface to an output surface;

b) a conductive layer that is formed on an outer surface of the at least one microchannel pore, the conductive layer having a non-uniform resistance as a function of distance through the at least one microchannel pore, the non-uniform resistance being selected to improve linearity by increasing gain as a function of input current and bias voltage compared with uniform resistance; and c) a first and a second electrode that are deposited on a respective one of the input and the output surfaces of the insulating substrate, the microchannel amplifier amplifying emissions propagating through the at least one microchannel pore when the first and second electrodes are biased.

28. The microchannel amplifier of claim 27 wherein the conductive layer is formed in the insulating substrate.

29. The microchannel amplifier of claim 27 wherein the conductive layer is formed from the insulating substrate.

30. The microchannel amplifier of claim 27 wherein the insulating substrate comprises a semiconductor material.

31. The microchannel amplifier of claim 27 wherein the insulating substrate comprises a silicon substrate.

32. The microchannel amplifier of claim 27 wherein the non-uniform resistance of the conductive layer is selected to increase resistance as a function of distance through the at least one microchannel pore from the input surface to the output surface.

33. The microchannel amplifier of claim 27 wherein the non-uniform resistance of the conductive layer is selected to increase resistance from the input surface to the output surface with an approximately linear function of distance through the plurality of microchannel pores.

34. The microchannel amplifier of claim 27 wherein at least some of the microchannel pores comprise a first diameter proximate to the input surface and a second diameter proximate to the output surface of the microchannel pores.

35. The microchannel amplifier of claim 34 wherein the diameter proximate to the input surface of the microchannel pores is greater than the diameter proximate to the output surface of the microchannel pores in order to increase an acceptance angle electrons.

* * * * *

UNITED STATES PATENT AND TRADEMARK OFFICE

CERTIFICATE OF CORRECTION

PATENT NO. : 7,408,142 B2
APPLICATION NO. : 11/532008
DATED : August 5, 2008
INVENTOR(S) : Beaulieu et al.

It is certified that error appears in the above-identified patent and that said Letters Patent is hereby corrected as shown below:

Col. 12, line 8 should read as follows:

--non-uniform resistance as a function of distance through the at--

Signed and Sealed this

Thirtieth Day of September, 2008

JON W. DUDAS
*Director of the United States Patent and Trademark Office*